US007183983B2

(12) United States Patent
Ozden

(10) Patent No.: US 7,183,983 B2
(45) Date of Patent: Feb. 27, 2007

(54) DUAL-LAYER ANTENNA AND METHOD

(75) Inventor: Sinasi Ozden, Copenhagen V (DK)

(73) Assignee: Nokia Corporation, Espoo (FI)

( * ) Notice: Subject to any disclaimer, the term of this patent is extended or adjusted under 35 U.S.C. 154(b) by 4 days.

(21) Appl. No.: 11/115,890

(22) Filed: Apr. 26, 2005

(65) Prior Publication Data

US 2006/0238423 A1 Oct. 26, 2006

(51) Int. Cl.
*H01Q 1/24* (2006.01)
*H01Q 1/38* (2006.01)
*H01Q 1/42* (2006.01)

(52) U.S. Cl. ..... 343/702; 343/700 MS; 343/872

(58) Field of Classification Search ..... 343/702, 343/700 MS, 846, 872, 873
See application file for complete search history.

(56) References Cited

U.S. PATENT DOCUMENTS

| | | | | |
|---|---|---|---|---|
| 4,571,595 | A | 2/1986 | Phillips et al. | 343/745 |
| 4,876,709 | A | 10/1989 | Rogers et al. | 379/61 |
| 5,212,462 | A * | 5/1993 | Gomez-Henry et al. | 333/136 |
| 5,337,061 | A | 8/1994 | Pye et al. | 343/702 |
| 5,696,517 | A | 12/1997 | Kawahata et al. | 343/700 |
| 5,896,109 | A | 4/1999 | Hachiga et al. | 343/702 |
| 5,943,019 | A | 8/1999 | Kawahata et al. | 343/702 |
| 6,097,339 | A | 8/2000 | Filipovic et al. | 343/702 |
| 6,124,831 | A * | 9/2000 | Rutkowski et al. | 343/700 MS |
| 6,239,765 | B1 * | 5/2001 | Johnson et al. | 343/795 |
| 6,603,430 | B1 * | 8/2003 | Hill et al. | 343/702 |
| 6,738,023 | B2 * | 5/2004 | Scott et al. | 343/700 MS |
| 6,756,946 | B1 | 6/2004 | Deng et al. | 343/742 |
| 7,031,762 | B2 * | 4/2006 | Shoji et al. | 455/575.5 |
| 2005/0242998 | A1 * | 11/2005 | Fabrega-Sanchez | 343/700 MS |
| 2005/0270240 | A1 * | 12/2005 | Qi et al. | 343/702 |
| 2005/0280585 | A1 * | 12/2005 | Scarpelli et al. | 343/702 |

FOREIGN PATENT DOCUMENTS

EP 0 246 026 A2 11/1987

(Continued)

OTHER PUBLICATIONS

Rasinger, J. et al., "A New Enhanced-Bandwith Internal Antenna For Portable Communication Systems", 1990 IEEE, pp. 7-12.

(Continued)

*Primary Examiner*—Trinh Vo Dinh
(74) *Attorney, Agent, or Firm*—Harrington & Smith PC

(57) ABSTRACT

A wireless communication device has a housing, an antenna, and a preferably flexible substrate. The housing has first and opposed second major surfaces. The antenna is fixed to the flexible substrate, and is disposed within the housing. The antenna has first and second antenna portions. The first antenna portion is disposed nearer to the first major surface than to the second, and the second antenna portion is disposed nearer to the second major surface than to the first. Preferably, the antenna radiates in two different frequency bands, and radiation in the higher band occurs entirely within the second antenna portion when the first major surface is a surface intended to mate with or lie adjacent to a user's head when the device is in use, so that the first antenna portion shields higher radiation that is received at or transmitted from the second antenna portion.

24 Claims, 6 Drawing Sheets

FOREIGN PATENT DOCUMENTS

| | | | |
|---|---|---|---|
| EP | 0 520 197 | B1 | 12/1992 |
| EP | 0 604 338 | B1 | 6/1994 |
| EP | 0 642 189 | B1 | 3/1995 |
| EP | 0 757 405 | A1 | 2/1997 |
| EP | 1538701 | A1 | 6/2005 |
| JP | 60-242705 | | 12/1985 |
| JP | 5-7109 | | 1/1993 |
| JP | 7-15223 | | 1/1995 |
| JP | 9-260922 | | 10/1997 |
| WO | WO-95/02284 | | 1/1995 |

OTHER PUBLICATIONS

Ali, M. et al., "A Meander-Line Bow-Tie Antenna", 1996 IEEE, pp. 1566-1569.

Fujimoto, K., excerpts from paper,"Small Antennas", Research Studies Press Ltd., pp. 116-117, 135-137, 1987.

Pedersen, G. F., excerpts from paper, "Integrated Antennas for Hand-Held Telephones", 1993, pp. 14, 19-20, 83, 122.

Parfitt, A. J. et al., "On the Modeling of Metal Strip Antennas Contiguous with the Edge of Electrically Thick Finite Size Dielectric Substrates", 1992 IEEE, pp. 134-140.

* cited by examiner

DUAL-LAYER ANTENNA AND METHOD

TECHNICAL FIELD

The present invention relates to antennas and related ground planes for wireless devices, and is particularly advantageous when used with clamshell or slide type mobile stations.

BACKGROUND

It is known that the radiation pattern from a transmitting antenna is defined by the antenna and an associated ground plane to which the antenna is coupled. An advantageous arrangement of antenna and ground plane is described in U.S. Pat. No. 6,097,339, hereby incorporated by reference. That reference describes a substrate antenna that includes one or more conductive traces supported on a dielectric substrate. The supporting substrate is mounted offset from and generally perpendicular to a ground plane associated with the device with which the antenna is being used, though the claims do not recite the perpendicular relation. The substrate antenna employs a very thin and compact structure that may be used as an internal antenna for wireless devices.

U.S. Pat. No. 6,097,339 purports to describe advantages in offsetting the substrate that supports the trace from an edge of the ground plane with which the antenna conductive trace resonates. However, such a disposition between the substrate-mounted antenna trace and the ground plane manifest additional problems that are less prevalent when the antenna overlies a major surface of the ground plane, problems that the reference does not address but which are explored below.

It is known that disposing an antenna in close proximity to, or in contact with, a person's body causes coupling to the body that degrades the quality of signals transmitted from and received at the antenna. Coupling between the antenna and a user is drastically reduced with increasing distance. However, this is not seen as a viable option for portable wireless devices because wireless handsets, mobile stations that a user holds in close proximity to his/her head to operate, remain popular. Increasing the handset size is generally not seen as commercially viable, given continuing consumer preferences for smaller portable wireless devices.

What is needed is an antenna for a wireless handset that reduces RF coupling with a user's body. It would be particularly desirable to provide such a solution that does not constrain further size reductions in portable wireless devices.

SUMMARY OF THE PREFERRED EMBODIMENTS

The foregoing and other problems are overcome, and other advantages are realized, in accordance with the presently preferred embodiments of these teachings.

In accordance with one embodiment is a wireless communication device that includes a housing, an antenna, and a (preferably flexible) substrate. The housing defines a first and an opposed second major surface. The antenna is fixed to the flexible substrate, and is disposed within the housing. The antenna includes a first and a second antenna portions. The first antenna portion is disposed nearer to the first major surface than to the second, and the second antenna portion is disposed nearer to the second major surface than to the first. The antenna portions are disposed such that at least a part of the first antenna portion lies between the second antenna portion and the first major surface of the housing. Preferably, the antenna radiates in two different frequency bands, and radiation in the higher frequency band occurs entirely within the second antenna portion when the first major surface is a surface intended to lie adjacent to a user's head when the device is in use.

In another embodiment of the present invention, a mobile station has first and second housing sections, grounding means and antenna means each disposed within the first housing section, and a substrate on which the antenna means is disposed. The antenna means includes a first and a second antenna section. The first antenna section is configured to receive radiation in a first frequency band and the second antenna section is configured to receive radiation in a second frequency band different from the first. The first housing means has a first and an opposed second major surface. The second antenna section of the antenna means is disposed between the first major surface and at least a portion of the second antenna section.

In accordance with another embodiment of the present invention, there is provided a method of making a wireless communication device, such as a mobile station. The method includes disposing an antenna on a substrate such that a first antenna portion lies on a first substrate portion, a second antenna portion lies on a second substrate portion, and a conductor joining the first and second antenna portions lies on a third substrate portion that is disposed between the first and second substrate portions. Further, the method includes mounting the substrate between opposed major surfaces of a device housing such that a line exists that passes through the first major surface to the first antenna portion to the second antenna portion and then the second major surface. That line exists when the device is fully assembled rather than transiently during assembly, and is preferably substantially perpendicular to the first major surface. Preferably, the first and second antenna portions are disposed on a flexible substrate that is folded and disposed in the housing such that the first and second antenna portions lie in substantially parallel planes.

Other features of the invention and more detail concerning various embodiments are described below.

BRIEF DESCRIPTION OF THE DRAWINGS

The foregoing and other aspects of these teachings are made more evident in the following Detailed Description of the Preferred Embodiments, when read in conjunction with the attached Drawing Figures, wherein.

DETAILED DESCRIPTION OF THE PREFERRED EMBODIMENTS:

The following terms are used in describing the invention and its embodiments. A mobile station MS is a handheld portable device that is capable of wirelessly accessing a communication network, such as a mobile telephony network of base stations that are coupled to a publicly switched telephone network. A cellular telephone, a Blackberry® device, and a personal digital assistant (PDA) with internet or other two-way communication capability are examples of a MS. A portable wireless device includes mobile stations as well as additional handheld devices such as walkie talkies and devices that may access only local networks such as a wireless localized area network (WLAN) or a WIFI network.

In certain arrangements where an antenna overlies its ground plane, the ground plane serves as a radio frequency (RF) shield for a user who holds a mobile phone handset to his ear. Changing the disposition so that the antenna and ground plane are abeam one another and not overlapping, as described in U.S. Pat. No. 6,097,339, removes that RF shield and allows the antenna to couple to a user's head to a much greater degree. It can be shown that such coupling causes signal degradation for the wireless device. Reducing that coupling would improve signal quality by improving effective antenna efficiency.

Figure 1B:
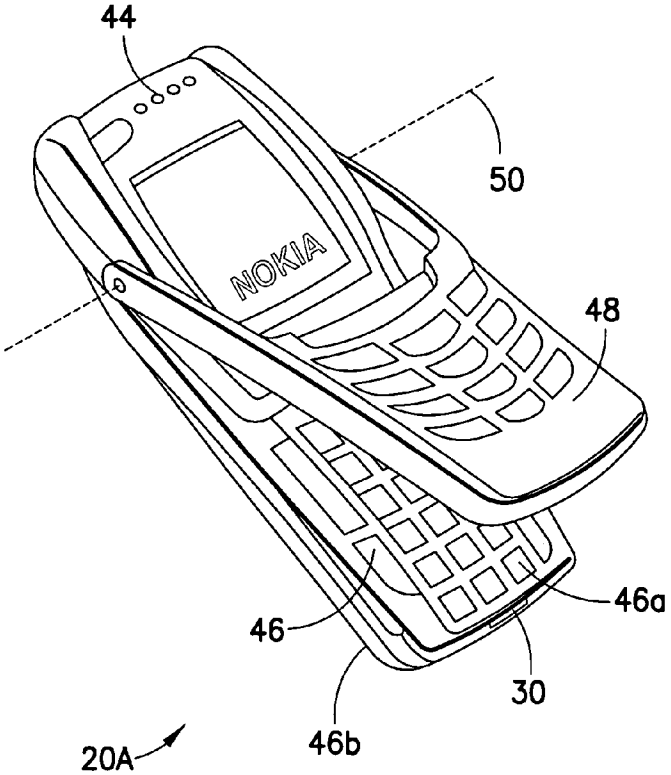
FIG. 1B is a perspective view of a flip-type mobile station.
Figure 1A:
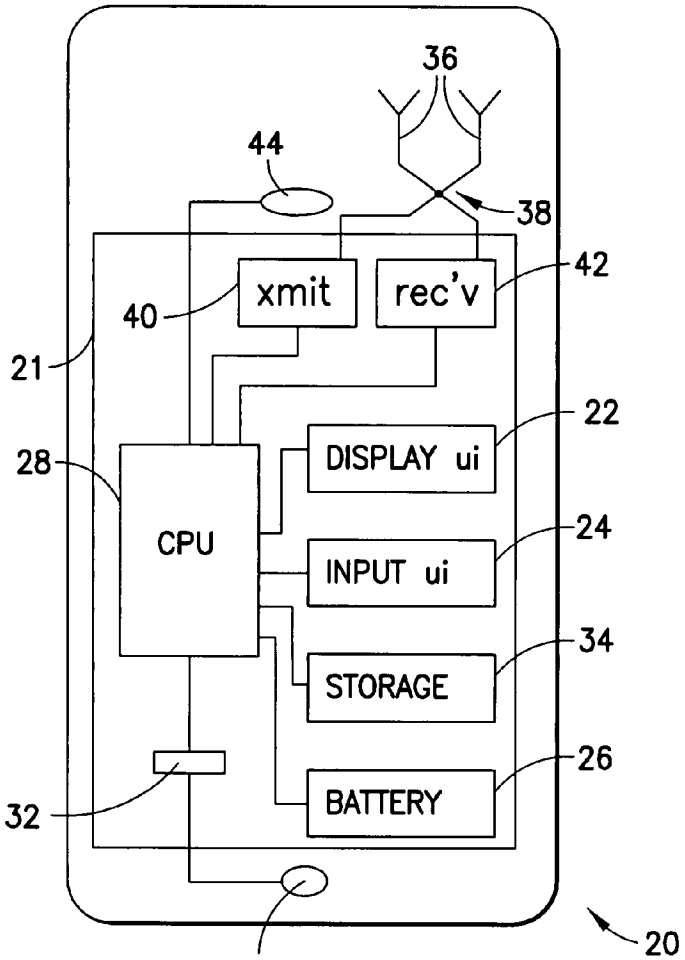
FIG. 1A is a block diagram showing major internal components of a mobile station.

FIG. 1A illustrates in block diagram a mobile station MS 20 in which the present invention may preferably be disposed. These blocks are functional and the functions described below may or may not be performed by a single physical entity as described with reference to FIG. 1A. A display user interface 22, such as a circuit board for driving a visual display screen, and an input user interface 24, such as a unit for receiving inputs from an array of user actuated buttons, are provided for interfacing with a user. The MS 20 further includes a power source 26 such as a self-contained battery that provides electrical power to a central processor 28 that controls functions within the MS 20. Within the processor 28 are functions such as digital sampling, decimation, interpolation, encoding and decoding, modulating and demodulating, encrypting and decrypting, spreading and despreading (for a CDMA compatible MS 20), and additional signal processing functions known in the art.

Voice or other aural inputs are received at a microphone 30 that may be coupled to the processor 28 through a buffer memory 32. Computer programs such as drivers for the display 22, algorithms to modulate, encode and decode, data arrays such as look-up tables, and the like are stored in a main memory storage media 34 which may be an electronic, optical, or magnetic memory storage media as is known in the art for storing computer readable instructions and programs and data. The main memory 34 is typically partitioned into volatile and non-volatile portions, and is commonly dispersed among different storage units, some of which may be removable. The MS 20 communicates over a network link such as a mobile telephony link via one or more antennas 36 that may be selectively coupled via a T/R switch 38, or a dipole filter, to a transmitter 40 and a receiver 42. The MS 20 may additionally have secondary transmitters and receivers for communicating over additional networks, such as a WLAN, WIFI, Bluetooth®, or to receive digital video broadcasts. Known antenna types include monopole, di-pole, planar inverted folded antenna, PIFA, and others. The various antennas may be mounted primarily externally (e.g., whip) or completely internally of the MS 20 housing. Audible output from the MS 20 is transduced at a speaker 44.

Most of the above-described components, and especially the processor 28, are disposed on a main wiring board 21. Typically, the main wiring board 21 includes a ground plane to which the antenna(s) 36 are electrically coupled. The ground plane may be a metal mass disposed on an underside of the wiring board 21, or a layer within the wiring board 21, or other fabrications known in the art.

FIG. 1B illustrates a flip-type MS 20A in which the components of FIG. 1A may be disposed. The flip-type MS includes first 46 and a second 48 housing sections that are hingedly coupled along a hinge axis 50. Typically, the majority of components described with reference to FIG. 1A are disposed within the first housing section 46 due to its larger volume. For reference to other portions of the description, the first housing section 46 defines a first major surface 46*a* and an opposed second major surface 46*b*. The first major surface 46*a* is configured for being placed adjacent to a user's head when the mobile station 20A is in use, in that the first major surface 46*a* is placed nearer the user's head than the second major surface 46*b*. Where the antenna 36 is disposed in the second housing section 48, typically a second ground plane is disposed therein with which the antenna 36 radiates. It is preferable in such an embodiment that the second ground plane is electrically coupled to the ground plane of the main wiring board 21 so that all electrical components operate with reference to the same common potential.

Figure 2:
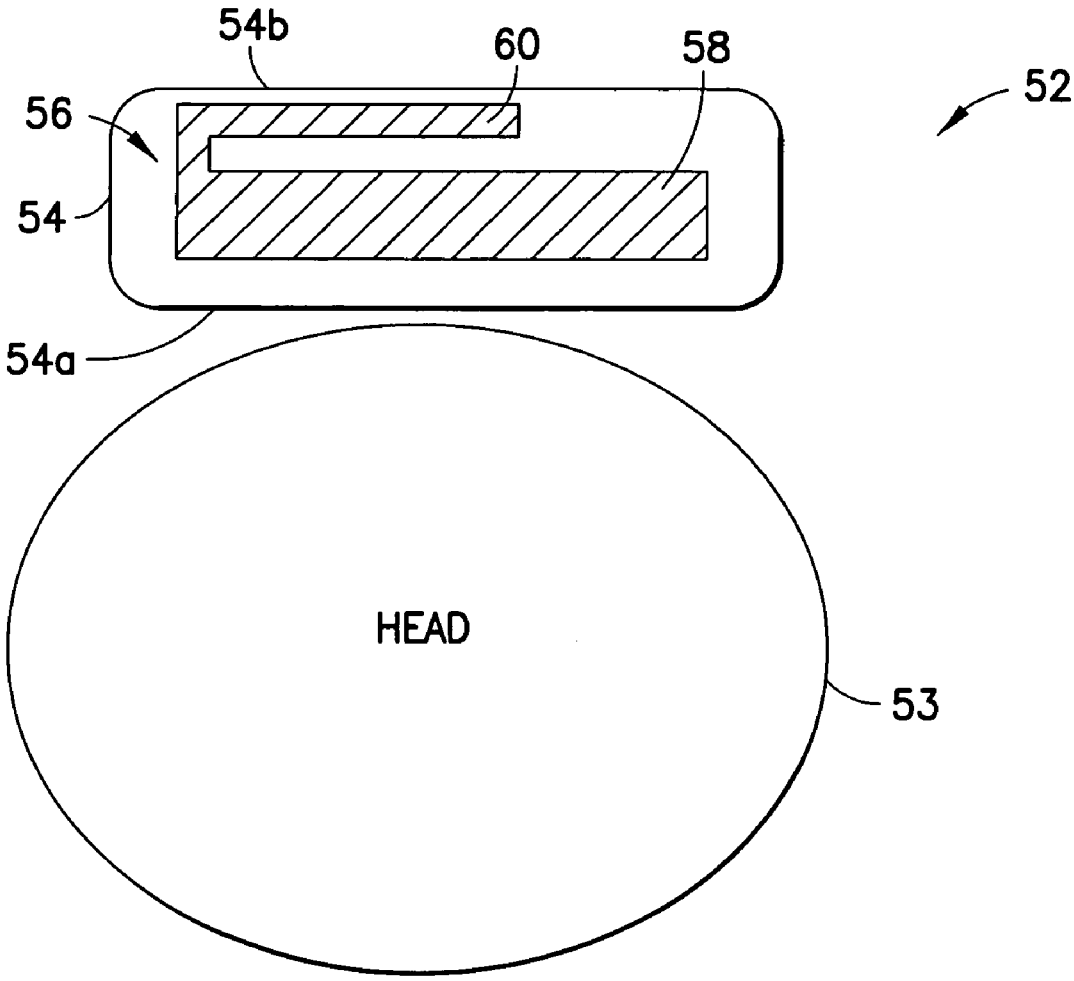
FIG. 2 is a conceptual block diagram showing antenna portions arranged according to the present invention in relation to a user's head.

An aspect of an embodiment of the present invention is shown in the conceptual block diagram of FIG. 2, which may be considered as a view from above of a cutaway MS 52 proximal to a user's head 53. The MS 52 has a housing 54 that defines a first major surface 54*a* for being disposed in proximity to (adjacent to) the user's head 53, and an opposed second major surface 54*b* that lies farthest from the user's head 53 when the MS 52 is in use. The antenna 56 includes two portions: a first portion 58 is disposed nearer to the first major surface 54*a* of the housing 54 than to the second major surface 54*b*; and the second portion 60 is disposed nearer to the second major surface 54*b* of the housing 54 than to the first major surface 54*a*. Each of the first and second antenna portions 58, 60 are active radiators within frequency bands in which the MS 52 operates. This is not to imply that only the first portion 58 comprises the whole of an active radiating antenna at any given frequency; the majority segment of a quarter wavelength antenna for example may lie in the first antenna portion 58 and a smaller segment may lie in the second antenna portion 60. Preferably, the MS 52 operates such that the second antenna portion 60 is active in one frequency band than the first antenna portion 58 is active in another frequency band. It is noted that the illustration of FIG. 2 is not to scale, and the thickness of the antenna portions 58, 60 are exaggerated for illustration. In a presently preferred embodiment, each of the antenna portions 58, 60 are conductive traces disposed on opposed surfaces (e.g., facing one another or facing away from one another) of a common flexible substrate mounted to a rigid support. Each conductive trace is preferably a copper or other metallic foil, non-rigid and non self-supporting, and having a thickness much less than their length or width. The ground plane is not shown in FIG. 2.

An advantage gained by disposing the antenna portions 58, 60 as in FIG. 2 is that the second antenna portion 60, which radiates in one frequency band, is shielded from the user's head 53 by the first antenna portion 58. This is in contrast to the antenna described in U.S. Pat. No. 6,097,339. In FIG. 2, the first and second antenna portions 58, 60 overlie one another, so the first antenna portion 58 shields RF transmissions at the second antenna portion 60 from coupling to the user's head 53. Such coupling degrades performance and is a direct function of distance between the user's head 53 and the radiating antenna. Disposing the second antenna portion 60 nearer the second major surface 54*b* of the housing 54 (which is furthest from the user's head 53) increases that distance. Disposing the first antenna portion 58 directly between the second antenna portion 60 and the housing first major surface 54*a* (that is, the antenna portions in a stacked relation to one another) allows the first antenna portion 58 to additionally shield RF transmissions in the band for which the second antenna portion 60 is active, which is preferably also the band at which the first antenna portion 58 is inactive.

Merely increasing the distance between the active radiating antenna and the user's head 53 results in larger device housings, or at least constrains further miniaturization. The use of embodiments of the present invention enables smaller housings and smaller wireless devices that exhibit reduced coupling to the user's head 53. Preferably, the first and second antenna portions 58, 60 are spaced from one another by about four mm, and more preferably by at least about two mm. This spacing is not necessarily an empty gap, but an antenna substrate or other component of the MS 52 may be disposed between the antenna portions 58, 60. As used with reference to antenna spacing, the term "about" means within one half of a millimeter of the specified value.

In certain embodiments, the second antenna portion 60 is configured to be active in a higher frequency band than the first antenna portion 58. The opposite is true in other embodiments. The choice is dependent upon a number of factors, including acceptable signal degradation in one band due to coupling with the user's head as compared to the other band, and regulatory requirements for imparting RF energy to a user, the allowable energy being different for different frequency bands. For example, regulatory requirements for coupling high frequency band RF energy to a user are more stringent in the United States than in Europe, yet signal degradation is generally more of a concern at the lower frequency bands. Embodiments in the United States may then preferably use the second antenna portion 60, as shielded by the first antenna portion 58, for a higher frequency band. Embodiments in Europe may make the opposite choice since regulatory requirements may be met without the shielding disclosed herein, and signal strength across all bands is better preserved with that opposite choice.

Figure 3C:
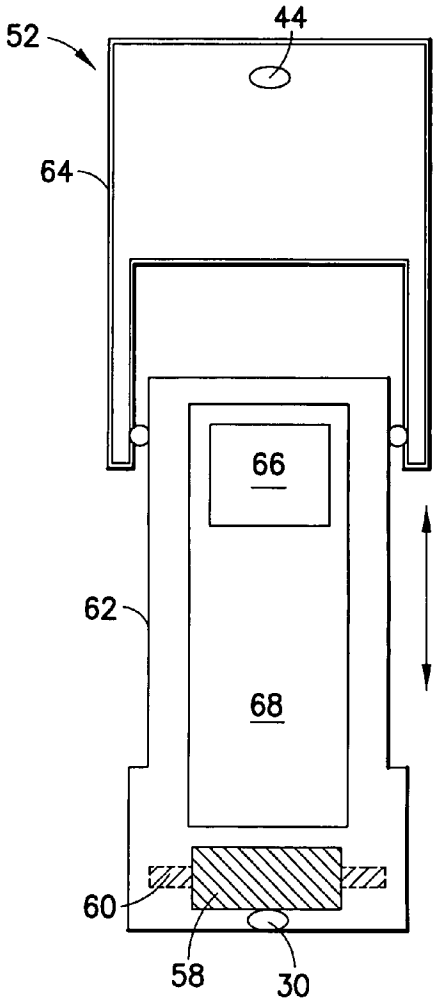
FIG. 3C is similar to FIG. 3B, but for a slide-type mobile station.

More particular embodiments are described below. FIG. 3A is a perspective view of a housing for a flip-type MS 20B. The housing has a first section 46 defining first 46*a* and opposed second 46*b* major surfaces, and a second housing section 48 defining first 48*a* and opposed second 48*b* major surfaces. The housing sections 46, 48 are coupled at a hinge axis 50 and moveable relative to one another along that axis.

Figure 3B:
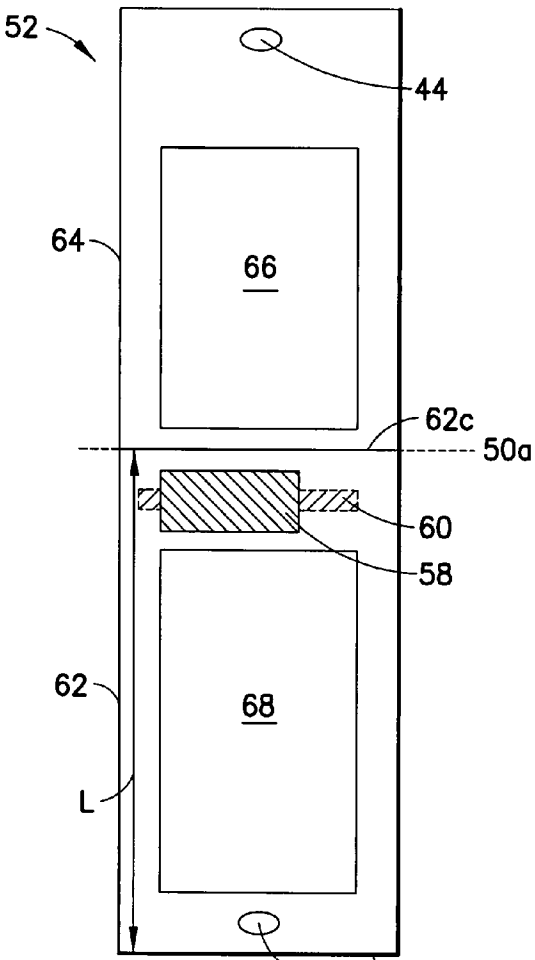
FIG. 3B is a block diagram showing relevant internal components of a flip-type mobile station according to the present invention.
Figure 3A:
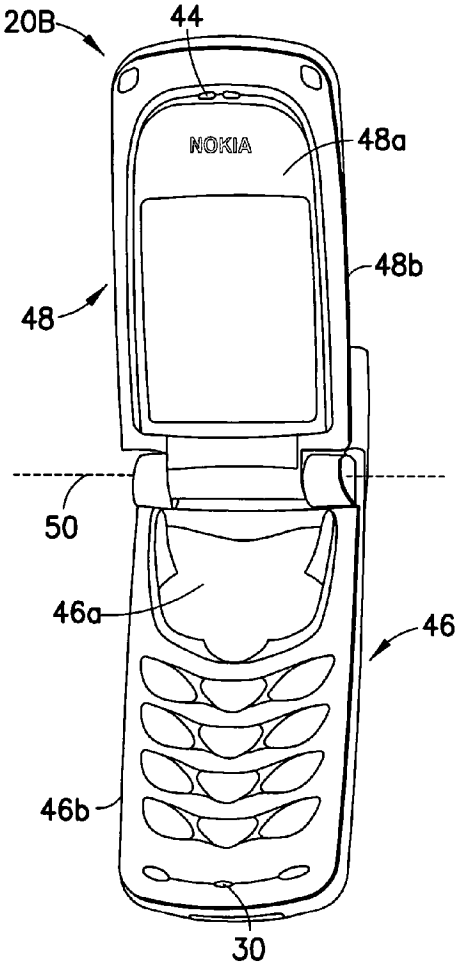
FIG. 3A is a plan view of a prior art flip-type mobile station.

FIG. 3B is a MS 52 of the flip-type incorporating aspects of the present invention. Specifically, the MS 52 has a housing that includes a first section 62 defining a first major surface facing the viewer that is intended for being placed adjacent to a user's head 53 and an opposed second major surface opposite the viewer of FIG. 3B, and a second housing section 64 defining similar first and second major surfaces. A display 66 may form a portion of the second housing section 64 first major surface. The sections 62, 64 are hingedly coupled at a hinge axis 50*a*. A ground plane 68 is disposed within the first housing section 62, as is the antenna that includes the first 58 and second 60 antenna portions. As illustrated, the ground plane 68 is an entire layer of a main circuit board. In FIG. 3B, the first antenna portion 58 is disposed directly between the second antenna portion 60 (shown in dashed outline) and the first major surface of the first housing section 62 (not shown in FIGS. 3B–3C). Where a longest dimension of the first housing section 62 is the length L between opposed ends 62*c*, 62*d*, preferably the entirety of both the first and second antenna portions 58, 60 are within L/4 of one of the opposed ends, either the end 62*c* nearest the hinge axis 50*a* or nearest the end 62*d* opposite the hinge axis. It is noted that unlike FIG. 3B, some mobile stations, such as the Nokia Communicator series (e.g., models 9210i, 9300, 9500), dispose a hinge axis along the longest length L. In such an instance, the opposed ends lie generally perpendicular to the hinge axis.

FIG. 3C is similar to FIG. 3B but showing a slide-type phone 55, the type being not unlike the Nokia model 7280, where the first 62 and second 64 housing portions are slideable relative to one another. In FIG. 3C, the MS 55 is shown in a hyperextended open position and the second housing section 64 slides in the direction of the arrow relative to the first housing section 62. Like reference numbers indicate like components. One distinction over FIG. 3B is that in FIG. 3C, the antenna portions 58, 60 are disposed to lie within about L/4 of the end 62*d* furthest from the second housing section 64. Either antenna location illustrated in FIGS. 3B–3C may be used in either embodiment.

Figure 4:
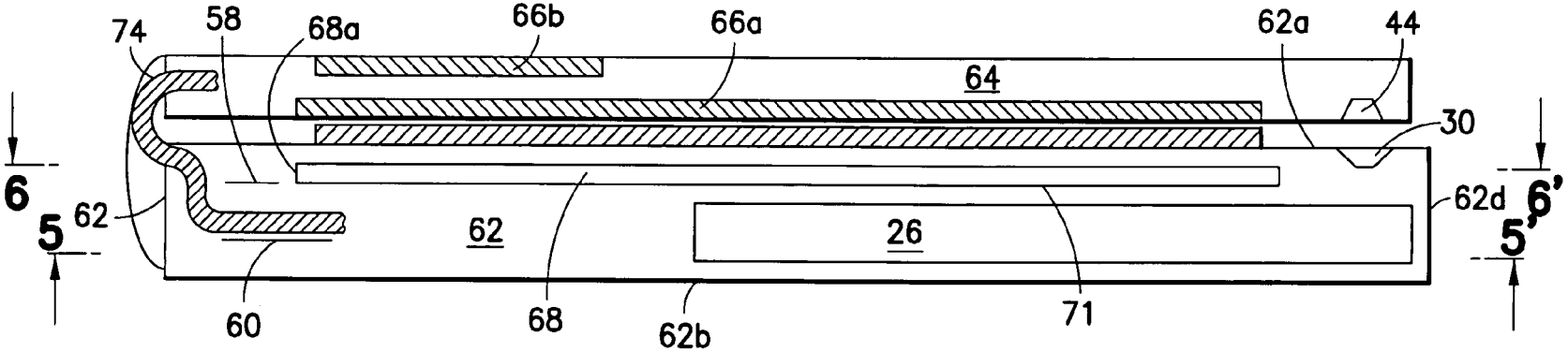
FIG. 4 is a cutaway block diagram showing a different view of relevant internal components of a flip-type mobile station according to the present invention.

FIG. 4 is a cutaway perspective view of the flip-type MS 52 showing the antenna portions 58, 60 in relation to the ground plane 68 (also illustrated as a layer of a main circuit board 71) and to the first major surface 62*b* of the first housing section 62. A second housing section 64 is hingedly coupled to the first housing section 62, and a main data cable 74 runs between them to power the primary display 66*a* and a secondary display 66*b*, as well as other components that may lie within the second housing section 64.

The first and second antenna portions 58, 60 are disposed on opposed surfaces of a mounting substrate (not shown), which is preferably a flexible dielectric film folded about a rigid plastic body so that the antenna portions overlie one another. The ground plane defines an edge 68*a* that is spaced from the first antenna portion 58. It is noted that some, but not the entirety of, the second antenna portion 60 overlies the ground plane 68, and is not spaced from that edge 68*a*. That disposition is more evident in FIG. 8.

Figure 5:
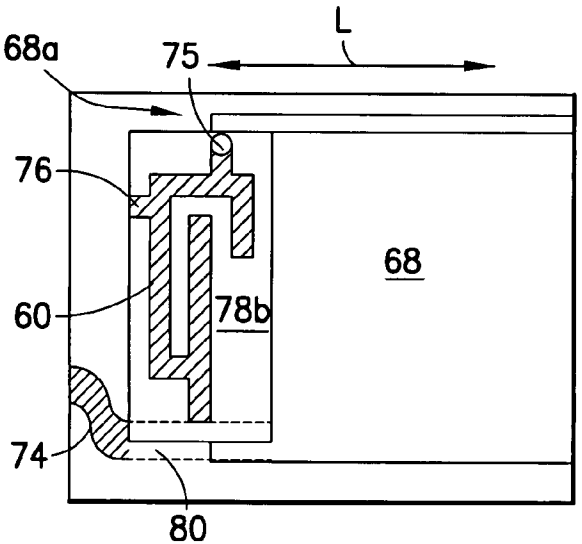
FIG. 5 is a cutaway plan view taken from section line 6–6' of FIG. 5.

FIG. 5 is a sectional view along the line 5–5' of FIG. 4, and illustrating the second antenna portion 60 in detail as mounted to a second substrate segment 78*b*. A pogo pin 75, spring clip, or other antenna coupling means is used to electrically couple the first antenna portion 58 to a feed that leads to other components that receive signals from and provide signals to the active antenna portions 58, 60. The antenna portions 58, 60 are coupled to one another via a conductor 76, such as a copper or other conductive trace, that is more particularly described with reference to FIG. 7. The conductor 76 preferably forms part of an active antenna element, and more preferably an active antenna element exists wholly within the second antenna portion. The distinction between antenna portion 58, 60 and active antenna element is detailed below.

A path 80 is defined by a projection of the main data cable 74, preferably a coaxial cable, as routed in the immediate vicinity of the first antenna portion 58, and the second antenna portion 60 preferably does not overlie any portion of the path 80. Viewing FIGS. 4–6 together, the path 80 is that projection perpendicular to the device height (height being between the top and bottom of FIG. 4), and perpendicular to a plane defined by the second antenna element 60. Such a projection extends from the actual cable 74 no greater than about twice the separation between the first and second antenna portions 58, 60.

Figure 6:
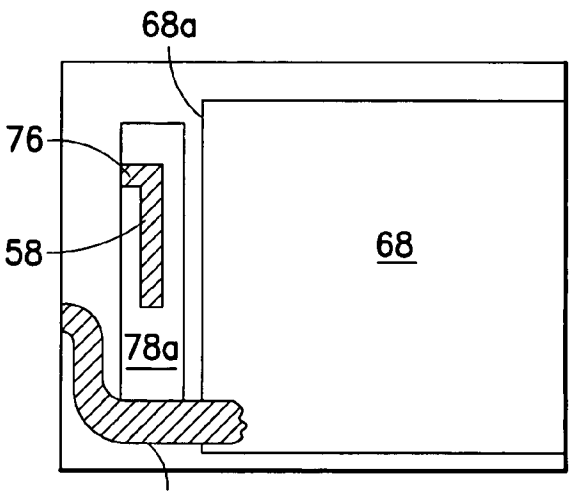
FIG. 6 is similar to FIG. 5, but taken from section line 7–7' of FIG. 5.

FIG. 6 is a sectional view along the line 6–6' of FIG. 4, and illustrating the first antenna portion 58 in detail. The first antenna portion 58 also does not overlie any portion of a path 80, which in this illustration is outlined by the actual coaxial cable 74. As the view of FIG. 6 is as would be seen from a user's head, it is clear that the position of the first antenna portion 58 acts as a shield to RF radiation from the second antenna portion 60.

Figure 7:
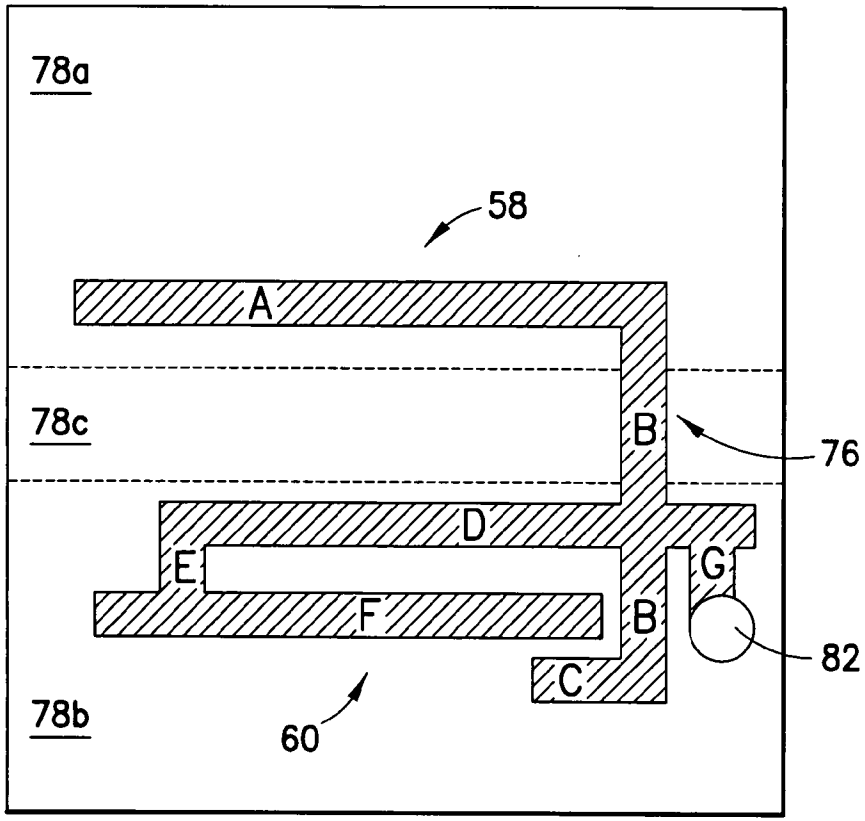
FIG. 7 is a view of the antenna portions disposed on a common substrate prior to folding.

FIG. 7 is a plan view of the antenna portions 58, 60 and the conductor 76 that couples them as mounted on a flexible substrate 78 prior to folding the substrate so the antenna portions 58, 60 overlie one another. The antenna portions 58, 60 and the conductor 76 may be the same conductive material, such as copper or other metallic traces disposed on a flexible dielectric film 78. The dielectric film 78 may further be disposed on a plastic support such as a rigid body about which the film 78 wraps about an edge. The first antenna portion 58 is disposed on a first substrate segment 78*a*; the second antenna portion 60 is disposed on a second substrate segment 78*b*, and the conductor 76 is disposed on a third substrate segment 78*c* disposed between first and second substrate segments 78*a*, 78*b*. The substrate film 78 is folded such that the first and second substrate segments 78*a*, 78*b* lie substantially in parallel planes, and preferably so that at least a portion of the first and second antenna portions 58, 60 directly overlie one another. Folding does not imply a crease; the third substrate segment 78*c* may be arcuate. The substrate 78 may be folded such that the first and second antenna portions 58, 60 face away from one another, or such that they face one another. A contact pad 82 is preferably of a larger cross section than the antenna traces for ease of contact with a signal feed.

While a flexible substrate film 78 is preferable for manufacturing efficiency, various substrates may be used to support either or both antenna portions 58, 60. A section of metal foil or sheet metal may also be flexible, and a di-electric coating may be disposed between the antenna portions and the foil/metal sections to electrically insulate the antenna portions. These metal sections may then be bent or folded over a rigid body, such as plastic, within the device housing. Alternatively, a self-supporting sheet metal section bearing the antenna portions 58, 60 may be mounted independently within the device housing after being bent or folded to place the antenna portions in the proper relative position as described herein. The antenna portions 58, 60 may alternatively be disposed on opposed surfaces of a rigid substrate that is then disposed within the device housing. This latter embodiment may be formed by a two-shot manufacturing process, where a conductive material that is to form the antenna portions 58, 60 is disposed within recesses of a mold (located at opposed inner surfaces of the mold), followed by injecting a substrate material such as plastic to fill the remainder of the mold cavity. The apparatus extracted from the mold is then a rigid substrate with the first and second antenna portions 58, 60 disposed on opposed outward-facing surfaces of the rigid substrate. As will be appreciated, numerous configurations of substrate and antenna portions are possible.

It is possible but not preferred to dispose one or both of the antenna portions on an exterior surface of the housing. In such an instance, it is highly desirable to cover the exposed antenna portion 58, 60 with a dielectric material so as to prevent direct coupling with a user's hand, in which case the dielectric material covering the otherwise exposed antenna becomes a part of the housing exterior surface and the covered antenna portion lies within the housing.

The various branches of the antenna portions and conductor are given letter designations to explain the distinction between active antenna element and antenna portions. All segments are electrically coupled. The first antenna portion may be considered as segment A of the overall trace, and the second antenna portion may be considered segments C, D, E and F (segment G not being an active radiative portion of the overall trace segments). Radiation in one frequency band resonates in segments A, B and C, where the majority of its length lies in the first antenna portion 58 and is disposed on the first substrate portion 78*a*. Radiation in another frequency band resonates in segments D, E and F, where the entirety of its length is within the second antenna portion 60 and disposed on the second substrate portion 78*b*. Segment G is a lead that couples the pad 82 to the active portions 58, 60. It is noted that while radiation in one frequency band is transmitted and received by segments of both the first 58 and second 60 antenna portions, radiation in the other frequency band is transmitted and received substantially only in segments of the second antenna portion 60 that are shielded from the user.

The active antenna portions 58, 60 (and possibly 76) may take any number of configurations. With the present invention, the second antenna portion 60 is particularly amenable to a wide variety of configurations without sacrificing the shielding advantages described herein, including a monopole turned back on itself as illustrated, a meandering or branched antenna, an antenna with a feed end and an opposed shorted end coupled to the ground plane or other common potential, or combinations of these. Such antennas are known in the art. Achieving an antenna length of one-quarter wavelength may be achieved, for frequencies in the 850 MHz to several GHz range for example, without the need to span a substantial portion of a width of the housing (width being that dimension between the longest length dimension L and the shortest height dimension), as do some conventional quarter wavelength antennas. This allows for the path 80 to remain clear of antenna traces. Typically, the length of an active radiating element will determine in what frequency band it is configured to transmit and receive.

Figure 8:
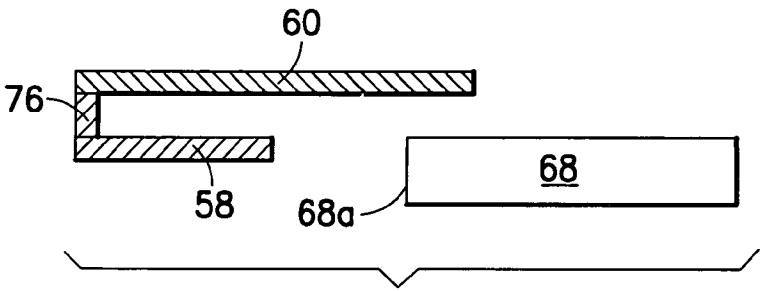
FIG. 8 is a conceptual block diagram showing only the antenna portions in relation to a ground plane.

FIG. 8 is a diagram showing the relationship between the antenna portions 58, 60 and the ground plane 68. The first antenna portion 58, which preferably operates in the lower frequency band, is spaced from an edge 68*a* of the ground plane 68 and does not overlie major surfaces of it. A segment, but not the entirety, of the second antenna element 60 overlies a major surface of the ground plane 68. The conductor 76 electrically couples the two antenna portions 58, 60. In the diagram of FIG. 8, the first major surface of the first housing section and the user's head are nearer the bottom of the drawing.

Figure 9:
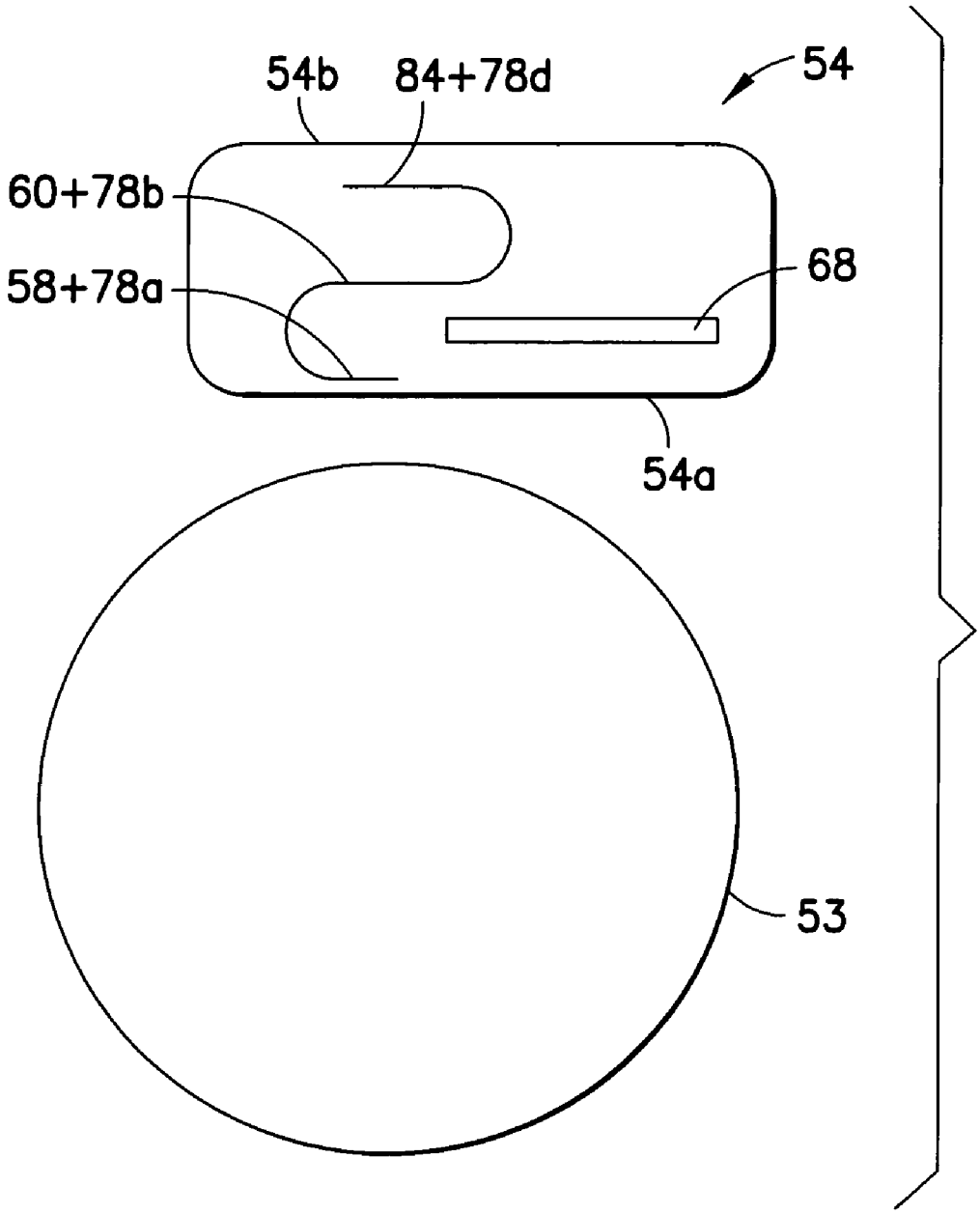
FIG. 9 is similar to FIG. 2, but an alternative embodiment with an associated ground plane for a tri-band mobile station.

The above teachings may be exploited for tri-band mobile phones or any number more than two frequency bands as follows, and as shown in FIG. 9. For a tri-band mobile station, the MS transmits in three frequency bands. Active antenna segments that radiate within a first frequency band may be disposed on the first substrate segment 78*a* that is nearest the user's head 53 (though it need not be entirely disposed there) while antenna segments active in two other frequency bands may be disposed on the second substrate segment 78*b* and shielded by the first antenna portion 58 disposed on the first substrate segment 78*a*. Alternatively and as depicted in FIG. 9, the active elements that radiate in a third frequency band may be disposed on a fourth substrate segment 78*d* as a third antenna portion 84, where the second substrate segment 78*b* is disposed between the first and fourth substrate segments 78*b*, 78*d* and radiates in a second frequency band, preferably between the first and second bands. The ground plane 68 may be disposed offset from one or more or even all of the antenna portions 58, 60, 84. Various combinations of stacked antenna portions may provide various levels of shielding commensurate with a reduction in likelihood of coupling to a user's head.

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes may be made therein without departing from the scope and spirit of the invention as set forth above, or from the scope of the ensuing claims.

What is claimed is:

1. wireless communication device comprising:

a housing defining a first major surface and an opposed second major surface;

an antenna disposed within the housing, the antenna comprising a first antenna portion disposed nearer said first major surface than the second major surface, and a second antenna portion disposed nearer said second major surface than the first major surface, in a position such that at least a part of the first antenna portion lies between the second antenna portion and the first major surface of the housing;

wherein the antenna is configured to radiate in a first frequency band using active elements of the first and second antenna portions, and to radiate in a second freguency band higher than the first frequency band with active elements of only the second antenna portion.

2. The wireless communication device of claim 1, wherein the substrate is flexible.

3. The wireless communication device of claim 1, wherein the first and second antenna portions define a space therebetween.

4. The wireless communication device of claim 3, wherein the space is greater than about two millimeters.

5. The wireless communication device of claim 1, wherein the first major surface is configured to be used adjacent to a user's head.

6. The wireless communication system of claim 1, wherein the antenna is configured to radiate in the first frequency band using the entirety of the first antenna portion.

7. The wireless communication device of claim 1 further comprising a ground plane disposed within said housing, said ground plane positioned such that less than the entirety of the first antenna portions overlies a ground plane major surfaces.

8. The wireless communication device of claim 1 wherein said housing comprises a first housing section that defines the first and second major surfaces and that further defines opposed ends separated by a longest dimension L, the device further comprising a second housing section moveably coupled to the first housing section, wherein the antenna is disposed entirely within a distance of L/4 of one of said opposed ends.

9. The wireless communication device of claim 8, wherein the first and second housing sections are hingedly coupled to one another.

10. The wireless communication device of claim 8, wherein the first and second housing sections are slideably coupled to one another.

11. The wireless communication device of claim 1 wherein the substrate is flexible and mounted to the housing.

12. The mobile communications device of claim 1, further comprising a speaker disposed adjacent to the first major surface.

13. A mobile station comprising:

a first housing section defining a first and an opposed second major surface;

a second housing section moveably coupled to the first housing section;

antenna means comprising a first and a second antenna section disposed within the first housing section, said antenna means configured to transmit radiation in a first frequency band using active elements of both the first and second antenna section, and to transmit radiation in a second frequency band different from the first frequency band using active elements of only the second antenna section; and a substrate on which the antenna means is disposed;

wherein at least a portion of the first antenna section is disposed between the first major surface and said active elements of only the second antenna section.

14. The mobile station of claim 13, wherein each of the first and second antenna sections comprise a conductive metallic trace, the mobile station further comprising grounding means coupled to the antenna means.

15. The mobile station of claim 13 wherein the first frequency band is lower than the second frequency band.

16. A method of making a wireless communication device comprising:

disposing an antenna on a substrate such that a first antenna portion lies on a first substrate portion, a second antenna portion lies on a second substrate portion, and a conductor joining the first and second antenna portions lies on a third substrate portion disposed between the first and second substrate portions, wherein the antenna is configured to radiate in a first freguency band using active elements of the first and second antenna portions and the conductor, and to radiate in a second freguency band using active elements excluding those of the first antenna portion; and mounting the substrate between opposed major surfaces of a device housing such that a line exists that passes, when the device is fully assembled, in order, through the first major surface, the first antenna portion, the second antenna portion, and the second major surface.

17. The method of claim 16, wherein the said device housing comprises a first housing section, the method further comprising:

movably attaching a second housing section to the first housing section.

18. The method of claim 17, wherein the first device housing defines opposed ends separated by a longest distance L, and wherein mounting the flexible substrate comprises mounting such that the entirety of the antenna lies within a distance of L/4 of one of the opposed ends.

19. The method of claim 16, wherein the second freguency band is higher than the first freguency band, and wherein a housing major surface nearest the first antenna portion is configured for being placed adjacent to a user's head when the device is in use.

20. The method of claim 16, further comprising coupling the antenna to a ground plane that is disposed between said major surfaces, wherein the said line is a first line and wherein mounting the substrate is further such that a second line exists that passes, when the device is fully assembled, in order, through the first major surface, either of but not both of the first or second antenna portions, the ground plane, and the second major surface, said second line parallel to the first.

21. The method of 20, wherein the first line is substantially perpendicular to the first major surface.

22. The method of claim 16, wherein the substrate is a flexible substrate and wherein mounting the substrate comprises folding the flexible substrate and disposing said substrate between opposed major surfaces of the device housing such that the said line exists.

23. The method of claim 16, wherein disposing an antenna on a substrate comprises disposing the first and second antenna portions the substrate such that the antenna portions lie in substantially parallel planes when the device is fully assembled.

24. The mobile station of claim 13, wherein the first major surface is configured for use adjacent to a user's head.

* * * * *